US010928094B2

(12) United States Patent
Mazzuca et al.

(10) Patent No.: US 10,928,094 B2
(45) Date of Patent: Feb. 23, 2021

(54) AIR REGISTER

(71) Applicants: Daniel Mazzuca, Hamilton (CA); Stacie Mazzuca, Hamilton (CA)

(72) Inventors: Daniel Mazzuca, Hamilton (CA); Stacie Mazzuca, Hamilton (CA)

(73) Assignees: Daniel Mazzuca, Hamilton (CA); Stacie Mazzuca, Hamilton (CA)

( * ) Notice: Subject to any disclaimer, the term of this patent is extended or adjusted under 35 U.S.C. 154(b) by 347 days.

(21) Appl. No.: 15/879,017

(22) Filed: Jan. 24, 2018

(65) Prior Publication Data

US 2019/0072294 A1 Mar. 7, 2019

Related U.S. Application Data

(60) Provisional application No. 62/553,964, filed on Sep. 4, 2017.

(51) Int. Cl.
*F24F 13/08* (2006.01)

(52) U.S. Cl.
CPC ..... *F24F 13/084* (2013.01)

(58) Field of Classification Search
CPC ..... F24F 13/084; F24F 13/06; F24F 13/08; F24F 13/10; F24F 13/14; F24F 2013/148; F24F 2007/003; F24F 13/142
USPC ..... 454/331, 332; D23/388, 389, 390, 391, D23/392
See application file for complete search history.

(56) References Cited

U.S. PATENT DOCUMENTS

| | | | | |
|---|---|---|---|---|
| 2,825,500 A | | 3/1958 | McLean | |
| 3,203,338 A | | 8/1965 | Dry | |
| D279,601 S | | 7/1985 | Sexton | |
| 4,676,145 A | | 6/1987 | Allred | |
| 4,821,628 A | | 4/1989 | Sarazen | |
| D315,790 S | | 3/1991 | Koessler | |
| D339,415 S | | 9/1993 | Kiras | |
| 5,275,405 A | | 1/1994 | Ridge | |
| D353,193 S | | 12/1994 | Porter | |
| 5,525,145 A | | 6/1996 | Hodge | |
| D393,708 S | * | 4/1998 | Assadi | D23/388 |
| 5,792,230 A | | 8/1998 | Moore | |
| D416,997 S | | 11/1999 | Prouty | |

(Continued)

FOREIGN PATENT DOCUMENTS

WO WO-2014036598 A1 * 3/2014 ..... F24F 13/084

OTHER PUBLICATIONS

Ventfansxpress: "Magnetic Ceiling Diffuser Retro-Fit Kit: Ventilation, Exhaust Fans and Air Moving Products" retrieved from http://www.ventfansxpress.com/products/Grilles-and-Registers/Plastic-Ceiling-Grilles/MAGNETIC-CEILING-DIFFUSER-Retro-Fit-Kit-SKU2590.html on Oct. 31, 2017.

(Continued)

*Primary Examiner* — Steven B McAllister
*Assistant Examiner* — Charles R Brawner
(74) *Attorney, Agent, or Firm* — Rowand LLP

(57) ABSTRACT

An air register includes a grating, a frame, and magnets. The frame has side and end walls and is sized to fit in a register boot. The walls extend substantially orthogonally from a rear face of the grating. The magnets are disposed substantially flush with an outside face of each of the walls for magnetically retaining the air register in register boots at least partially formed of one or more magnetic materials.

18 Claims, 3 Drawing Sheets

(56) References Cited

U.S. PATENT DOCUMENTS

| | | | | |
|---|---|---|---|---|
| 6,159,092 | A * | 12/2000 | Elder | B60H 1/3421 454/152 |
| 6,234,893 | B1 * | 5/2001 | Meredith | F24F 13/085 454/289 |
| 6,322,442 | B1 | 11/2001 | Cordell | |
| 6,422,935 | B1 | 7/2002 | Yampolski | |
| D463,202 | S | 9/2002 | Smith | |
| D467,768 | S | 12/2002 | Becker | |
| D572,358 | S | 7/2008 | Nattrass | |
| D595,832 | S | 7/2009 | Asselbergs | |
| 7,651,390 | B1 * | 1/2010 | Profeta | F24F 13/06 454/284 |
| D622,033 | S | 8/2010 | Lambertz | |
| 8,016,921 | B2 | 9/2011 | Hassell | |
| D654,162 | S | 2/2012 | Sykes | |
| 8,292,708 | B2 | 10/2012 | Viggers et al. | |
| 8,419,515 | B1 * | 4/2013 | Dillon | F24F 13/084 454/284 |
| D717,595 | S | 11/2014 | Knoll | |
| D718,086 | S | 11/2014 | Lewis | |
| D738,999 | S | 9/2015 | Funnell, II | |
| 9,726,395 | B2 | 8/2017 | Hammer | |
| D804,644 | S | 12/2017 | Krob | |
| D805,628 | S | 12/2017 | Green | |
| D809,114 | S | 1/2018 | Funnell, II | |
| D825,049 | S | 8/2018 | Miskel | |
| D827,122 | S | 8/2018 | Heinrichs | |
| D827,333 | S | 9/2018 | Patton | |
| D847,536 | S | 5/2019 | Patton | |
| D850,610 | S | 6/2019 | Drummond | |
| 2006/0270336 | A1 | 11/2006 | Ascroft | |
| 2006/0292978 | A1 | 12/2006 | Romanuik | |
| 2009/0120291 | A1 | 5/2009 | Hassell | |
| 2009/0221225 | A1 * | 9/2009 | Treu | F24F 13/082 454/290 |
| 2012/0124951 | A1 | 5/2012 | Miskel | |
| 2018/0271282 | A1 * | 9/2018 | Bishop | F16B 1/00 |
| 2019/0170390 | A1 | 6/2019 | Kennedy | |

OTHER PUBLICATIONS

AskMetaFilter: "How do I get some ceiling vents to stay in place?" http://ask.metafilter.com/156826/How-do-I-get-some-ceiling-vents-to-stay-in-place, Oct. 31, 2017.

Homedepot: "Reachable Magnetic Ceiling Vent HVAC Cover—Wine Design 20 in. × 30 in." retrieved from https://www.homedepot.com/p/REACHABLE-Magnetic-Ceiling-Vent-HVAC-Cover-Wine-Design-20-in-×-30-in-WWXCG20X30/207192572, Feb. 28, 2018.

katc.com: "Local man invents product to make changing air conditioner filters safer" posted on Feb. 18, 2016, retrieved from http://www.katc.com/story/31259065/local-man-invents-product-to-make%20-changing-air-conditioner-filters-easier?clienttype=generic, Feb. 28, 2018.

Filtersfast: "Magnetic Vent Cover HVAC Air Filter 4×18" retrieved from http://www.filtersfast.com/mobile/P-magnetic-vent-cover-hvac-air-filter-4×18.asp, Feb. 28, 2018.

U.S. Office Action dated Sep. 19, 2019, U.S. Appl. No. 29/635,805.

* cited by examiner

AIR REGISTER

RELATED APPLICATIONS

This application claims the benefit of priority from U.S. Provisional Application No. 62/553,964, filed on Sep. 4, 2017, the contents of which are herein incorporated by reference in their entirety.

FIELD

This application relates to heating, ventilating, and/or cooling (HVAC) systems and, more particularly, to air registers.

BACKGROUND

HVAC systems may distribute air by way of ducts. Air channeled by ducts may be distributed into rooms and other spaces by way of registers.

A duct system may include one or more register boots, which are also referred to as duct boots. Register boots allow ducts such, as for circular ducts, to be channeled to a register. Register boots provide an outlet, which is often rectangular in shape, into which a register can be inserted. Register boots may be formed of a variety of materials and may be formed using various techniques. In one example, register boots may be made of sheet metal and may be formed using one or more well-known metal working techniques. In another example, register boots may be made of plastic and may be formed, for example, using injection molding.

Air registers, which may also be referred to as registers, vents, vent covers, or register covers, include gratings that allow air to pass out of a duct (through the register boot) into a room or other space. The gratings of air registers may also provide the benefit of preventing or limiting the ability of foreign objects to enter into ducts.

In some cases, it may be necessary to secure air registers in place. For example, because of the action of gravity, registers inserted into register boots venting through, for example, a wall or ceiling may need to be secured against tilting or falling. Additionally or alternatively, air registers may be secured to prevent tampering such as, for example, by children. Registers are often secured using screws that screw into an adjacent wall, ceiling, or floor through screw holes in a lip of the register. Such screws may however, pull out over time such as, for example, when a wall or ceiling is formed of drywall, especially if there is no framing behind the wall in the area of the screw and appropriate anchors are not used. Further, because it may be necessary to remove air registers periodically such as, for example, to allow ducts to be cleaned, such screw holes may become stripped through repeated removal and insertion of the screws even if the hole is partly in framing or an anchor is employed. Additionally, inserting and removing screws may be cumbersome and could result in increased costs for register installation and/or removal such as, for example, during construction and/or cleaning.

BRIEF DESCRIPTION OF THE DRAWINGS

Embodiments are described in detail below, with reference to the following drawings.

Like reference numerals are used in the drawings to denote like elements and features.

DETAILED DESCRIPTION

In one aspect, there is provided an air register including a grating, a frame, and magnets. The frame has side and end walls and is sized to fit in a register boot. The walls extend substantially orthogonally from a rear face of the grating. The magnets are disposed substantially flush with an outside face of each of the walls for magnetically retaining the air register in register boots at least partially formed of one or more magnetic materials.

Conveniently, such an air register may be magnetically retained in a register boot formed of a magnetic material.

Other aspects and features of the present application will be understood by those of ordinary skill in the art from a review of the following description in conjunction with the accompanying figures.

Figure 1:
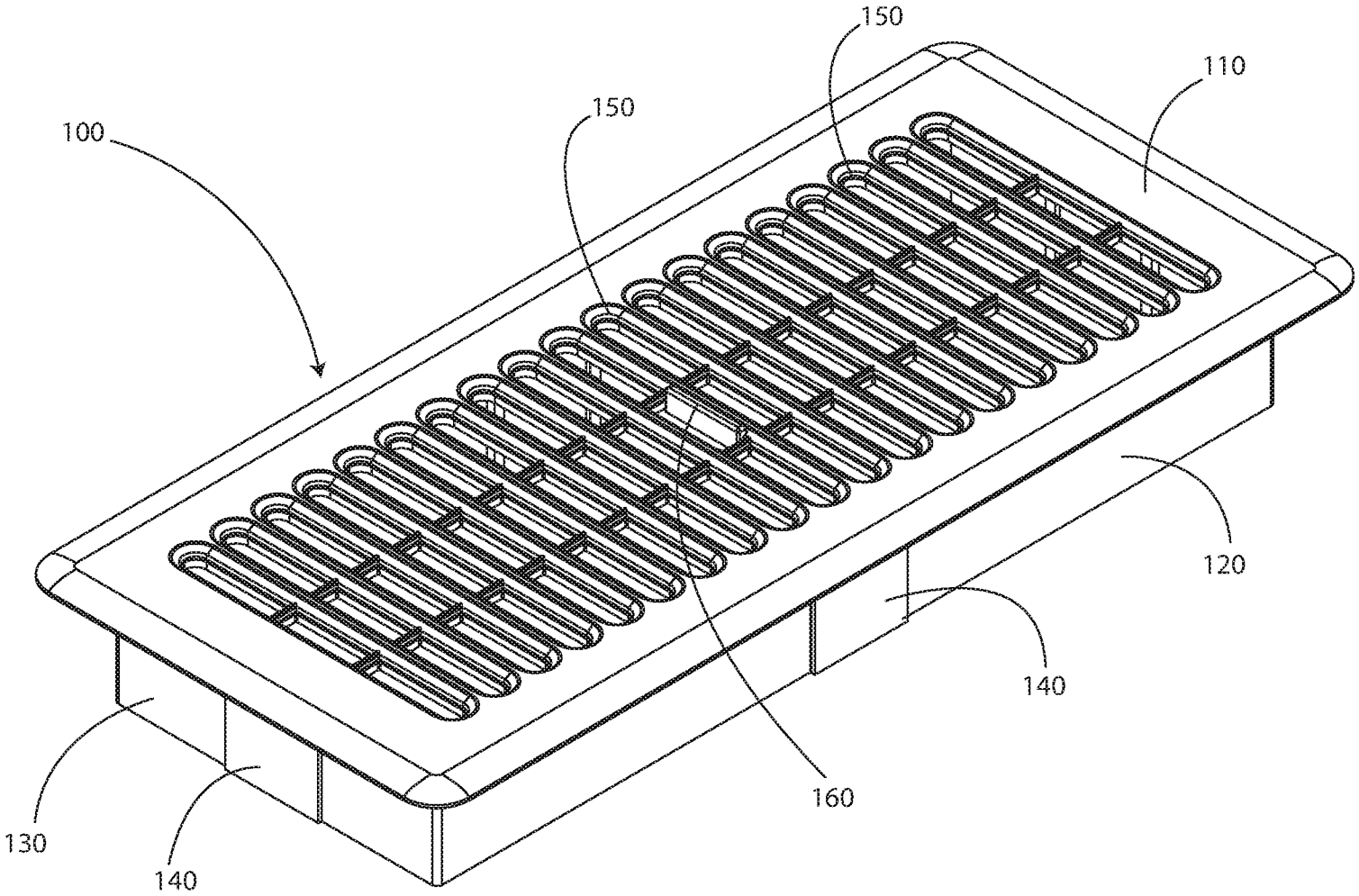
FIG. 1 is a perspective view of an example air register according to the present application.

FIG. 1 is perspective view of an air register 100 according to the present application.

As illustrated, air register 100 includes a grating 110, walls—in particular, side walls 120 and end walls 130—and magnets 140.

Figure 2:
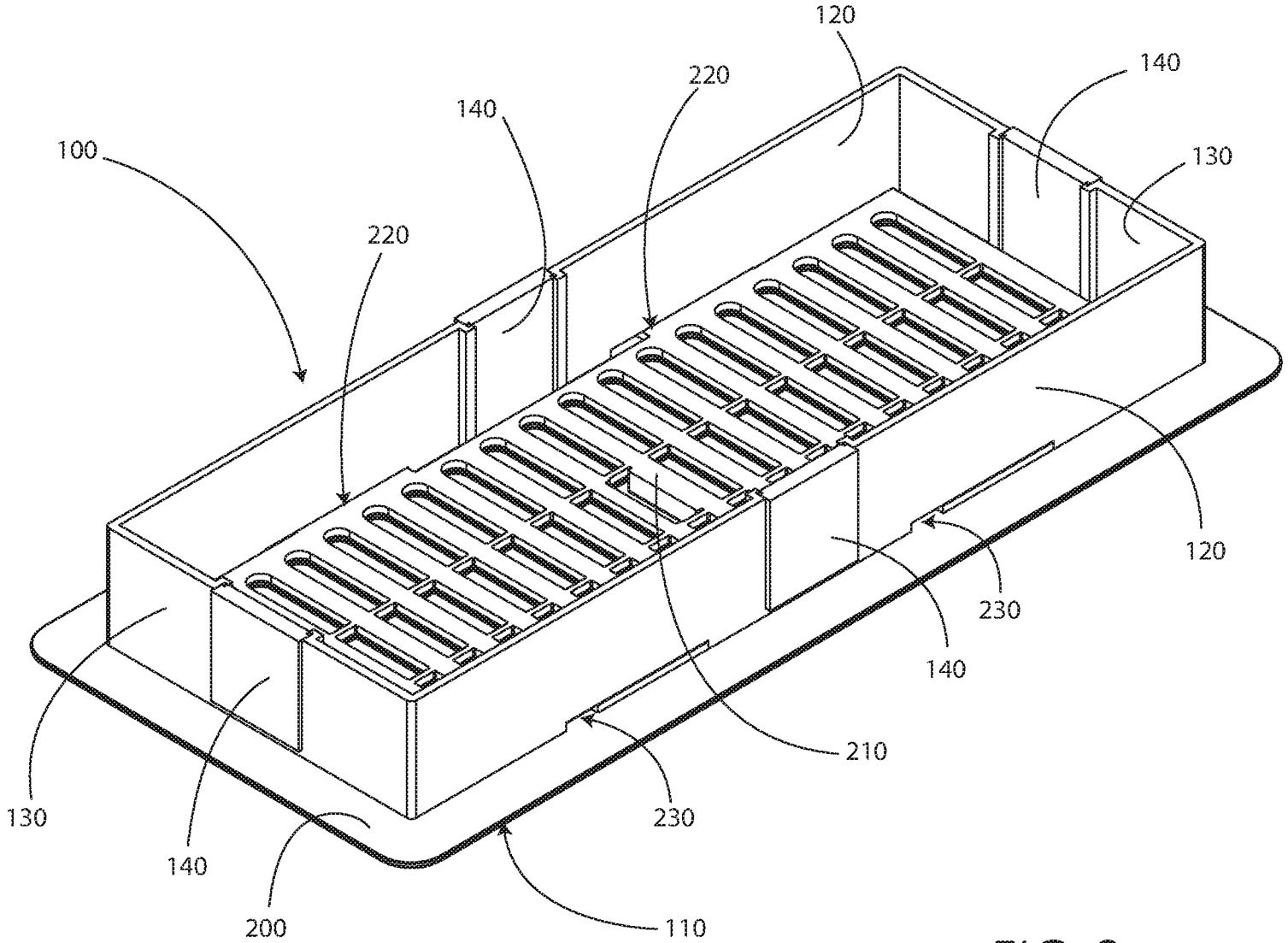
FIG. 2 is a further perspective view of the air register of FIG. 1 showing the rear face of the grating of the air register.

FIG. 1 shows a front face of the grating 110. FIG. 2 is a corresponding perspective view of the air register 100 showing a rear face of the grating 110.

As illustrated, the grating 110 includes openings 150 through which air may flow through the air register 100 into a space such as, for example, a room.

As best shown in FIG. 2, the side walls 120 and the end walls 130 extend substantially orthogonally from the rear face of the grating 110. The side walls 120 and the end walls 130 cooperate to define a substantially rectangular frame. The frame may be sized to fit into a register boot. For example, the frame may be sized to fit a register boot having a four-by-ten-inch opening.

In some embodiments, one or more of the side walls 120 may, as shown, meet one or both of the end walls 130 at respective corners of the frame. Alternatively, there may be a gap between one or more of the side walls 120 and one or both of the end walls 130 such that the frame is not fully enclosed by a single wall.

As illustrated, magnets 140 are disposed along outside faces of the side walls 120 and the end walls 130. Each of the magnets 140 may be fixedly positioned relative to the walls. The magnets 140 may, as illustrated, be substantially flush with the outside face of the side walls 120 and the end walls 130. Conveniently, in this way, the opening for air flow through the frame may be maximized while still having the air register 100 fit into a particular size of register boot as compared to if one or more of the magnets 140 protruded from an outside face of the walls. The magnets 140 being substantially flush with the outside face of the side walls 120 and the end walls 130 may also prevent or limit damage to the magnets 140 during handling of the air register 100 such as, for example, chipping of the magnets 140. Additionally or alternatively, the magnets 140 may, as illustrated, be substantially flush with the inside face of the side walls 120 and the end walls 130. Conveniently, in this way, protrusions into the frame may be avoided. Avoiding protrusions into the frame may limit obstruction or diversion of air flow therethrough.

In some embodiments, there may be, as illustrated, a single one of the magnets 140 corresponding to each one of the side walls 120 and the end walls 130. Those magnets may, for example, be centrally-positioned—e.g., in the middle of—a respective one of the side walls 120 or the end walls 130 as shown. Alternatively, more than one of the magnets 140 may be disposed along a particular one or more of the side walls 120 and/or the end walls 130. For example, one of the side walls 120 could include more than one magnet. In a particular example, magnets may be spaced evenly along a particular one (or ones) of the side walls 120 and/or the end walls 130 that include more than one of the magnets 140.

In some embodiments, those of the magnets 140 disposed along a particular one of the walls of the frame may, as illustrated, be positioned in opposition to those other of the magnets 140 disposed along an opposite one of the walls of the frame. For example, as shown, the one of the magnets 140 disposed along one of the side walls 120 is opposite the other of the magnets 140 disposed along the other of the side walls 120 and similarly so for the end walls 130. Conveniently, positioning magnets so opposed may serve to limit or prevent twisting or shifting of the air register 100 in a register boot due to the opposing nature of the magnetic attraction of each the opposed magnets to a respective adjacent wall of a magnetic register boot as compared to the magnetic forces stemming from the magnet opposite that magnet.

The magnets 140 may be sized and positioned so as to not substantially extend into an interior of the frame defined by the side walls 120 and the end walls 130. Conveniently, in this way, obstruction by the magnets 140 of the air flow through the frame may be limited.

The magnets 140 may, as illustrated, be rectangular magnets. Additionally or alternatively, the magnets 140 may include one or more magnets of other shapes (not shown).

One or more of the magnets 140 may act to magnetically retain the air register 100 in a register boot formed of a magnetic material. For example, one or more of the magnets 140 may act to magnetically retain the air register 100 in a register boot formed of a ferromagnetic material. In a particular example, one or more of the magnets 140 may act to magnetically retain the air register 100 in a register boot made of galvanized steel.

The magnets 140 are selected to provide sufficient magnetic force for retaining the air register 100 in the opening of a register boot. For example, where the air register 100 is a ceiling register, the magnets 140 may be selected to provide sufficient magnetic force for retaining the air register 100 against the pull of gravity. Additionally or alternatively, the magnets 140 may be selected to retain the air register 100 in place against the force of blowing air such as, for example, when a damper (further described below) of the air register 100 is closed, thereby limiting or even blocking the flow of air through the openings 150. Conveniently, in this way rattling of the air register 100 due to air flow such as, for example, rattling of one or more of the side walls 120 and/or the end walls 130 against a register boot, may be limited. Additionally or alternatively, expulsion of the air register 100 from a register boot due to air flow may be prevented. For example, it may be that the magnetic force provided by the magnets 140 acts to oppose the air register 100 being expelled from a register boot due to air flow when the above-mentioned damper is closed. Another consideration in the selection of the magnets 140 may, for example, be that the force required for removing the air register 100 from a register boot—i.e., by overcoming the magnetic force—should not be so much as to make removal difficult for an ordinary adult. Additionally or alternatively, it may be a consideration in the selection of the magnets 140 that sufficient force for removing the air register 100 from a register boot should be required that a child could not easily remove the air register 100 such as, for example, from a floor opening. In some embodiments, one or more of the magnets 140 may be rare-earth magnets such as, for example, neodymium magnets.

Each of the magnets 140 may magnetically engage with a wall of the opening of a magnetic register boot so as to magnetically retain the air register 100 in the register boot. In some cases, however, register boots may only be nominally of their defined size and dimensions or features thereof such as, for example, opening sizes, may vary from register boot to register boot. For example, it may be that the tolerances in forming a register out of sheet metal are sufficiently loose that one or more of magnets 140 may, when the air registered is inserted into a register boot, be spaced apart from a wall of the register boot so as to not touch it. Such a gap may, due to the distance between such a magnetic wall and the corresponding one or more of the magnets 140, lessen the attractive force between those ones of the magnets 140 and the register boot. A lessened attractive force may reduce or limit the magnetic force retaining the air register 100 in the register boot. Accordingly, the magnets 140 may be selected so as to allow sufficient magnetic force to be provided for magnetically retaining the air register 100 in the opening of the register boot even if only a subset of the magnets touch and/or substantially engage magnetically with walls of a register boot opening. For example, the magnets 140 may be selected so that only the magnets in one of the end walls 130 and one of the side walls 120 are required to touch or substantially engage magnetically with corresponding sides of a register boot in order to magnetically retain the air register 100 in the register boot.

As illustrated, each of the end walls 130 and the side walls 120 has an outer edge along the part of the wall furthest from the rear face of the grating 110. One or more of the magnets 140 may extend to such an outer edge of a corresponding one of the walls. Conveniently, magnets so extending may be easier to engage magnetically with a register boot such as, for example, if the register boot is set back somewhat from the surface of the wall, ceiling, or floor (as the case may be). Additionally, it may be that one or more of the magnets 140 spans along the height of the corresponding one of the walls from the outer edge of the wall to the base of the wall—i.e., at the rear face of the grating 110.

In some embodiments, the air register 100 may include a lip 200 (FIG. 2). The lip 200 may allow the air register 100 to be pried or pulled from a register boot. Additionally or alternatively, the lip 200 may prevent the air register 100 being too deeply inserted into a register boot such that it may be difficult to retrieve, such as, for example, if a floor register is pushed or stepped on. It may be that the air register 100 is difficult to remove if too deeply inserted into a register boot because of the need to overcome magnetic retention. Additionally or alternatively, the lip 200 may act to hide an unfinished edge of either the wall/floor/ceiling surface adjacent the boot or and/or a gap between the adjacent surface and the boot.

As mentioned above, the air register 100 may, as illustrated, include a damper 210 (FIG. 2). The damper 210 may be operated using a handle 160 (FIG. 1) so as to open or obstruct the openings 150.

The damper 210 may, as shown, be formed as another grating. The damper 210 may include one or more fins 220 (FIG. 2) that fit in channels 230 defined between the side walls 120 and the grating 110 and act to retain the damper 210 in a position proximate to or up against the grating 110. In some embodiments, the fins 220 may slide back and forth in respective ones of the channels 230 as the damper 210 is operated using the handle 160. Conveniently, such a damper mechanism may be easy to manufacture due to a small part count. Additionally or alternatively, such a damper mechanism may be easy to assemble with the air register 100 by displacement or snap fitting the damper 210 into the channels 230.

In some embodiments, the damper 210 may take other forms such as, for example, one or more louvres (not shown) such as may, for example, be operated by rotating or sliding a suitable variant of the handle 160.

In some embodiments, the magnets 140 may also act to secure the air register 100 from shifting during operation of a damper 210.

Figure 3:
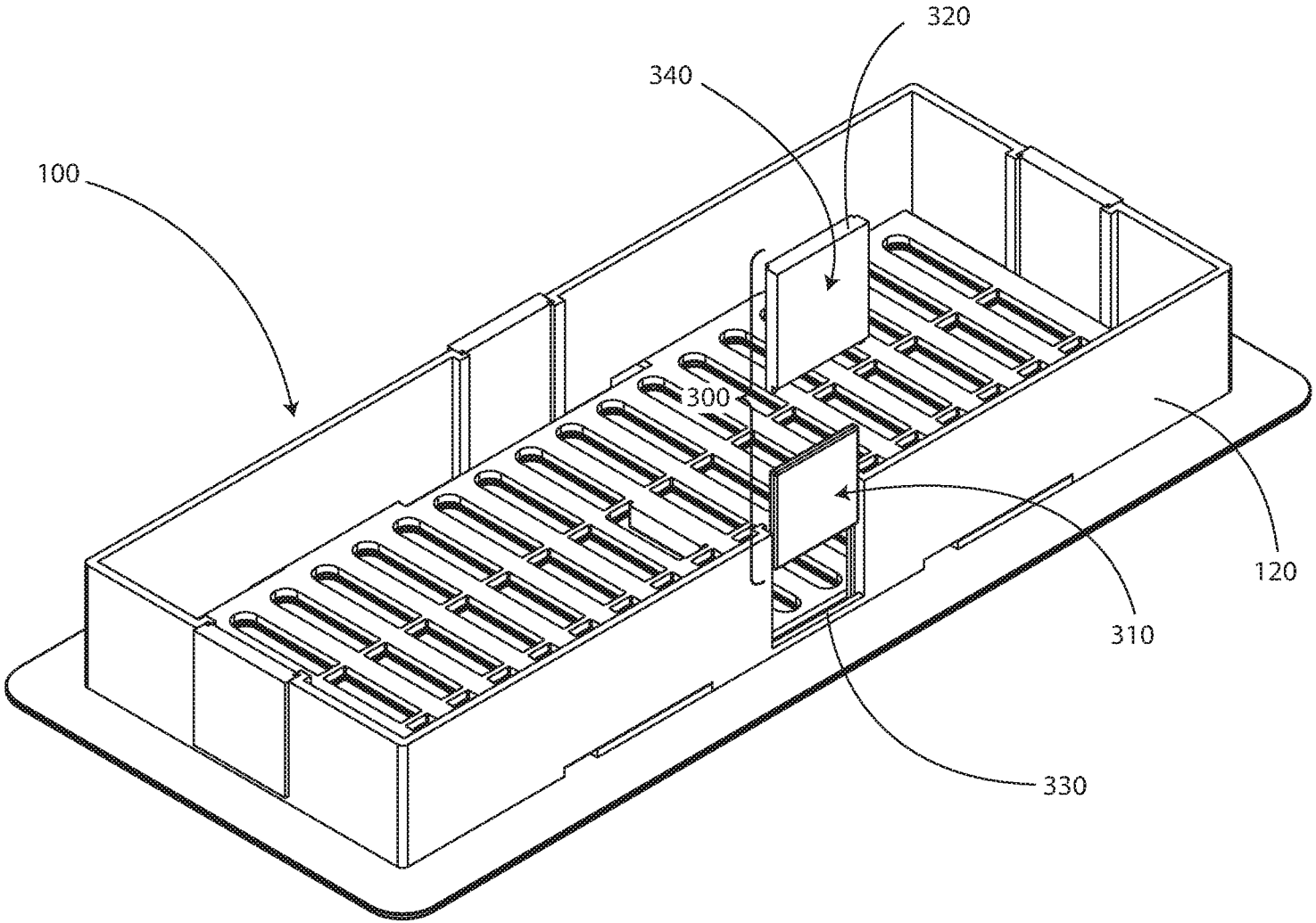
FIG. 3 is an exploded perspective view of the air register of FIG. 1.

In some embodiments, one or more of the magnets 140 may include a cover. FIG. 3 is an exploded perspective view of the air register 100 showing components of one of the magnets 140, namely a magnet 300, including such a cover.

As illustrated, the magnet 300 includes a magnet element 310 and a cover 320. The magnet 300 is received in a slot 330 in one of the walls of the frame of the air register 100, namely in one of the side walls 120.

In some embodiments, one or more covers akin to the cover 320 may be provided, each of the covers covering a corresponding one of the magnets along at least the outside face of the outside face of wall of the frame—i.e., of side walls 120 and/or end walls 130.

The magnetic element 310 may, as illustrated, be a rectangular bar magnet. Alternatively, the magnetic element 310 may have another shape. In some embodiments, a non-rectangular magnetic element that is a non-rectangular may be adapted to fit in a slot by a suitably-shaped cover. For example, a suitable cover may adapt a non-rectangular magnet to fit in a rectangular slot. The magnetic element 310 is a permanent magnet. For example, the magnetic element 310 may be a rare-earth magnet such as, for example, a neodymium magnet.

The cover 320 acts to protect the magnetic element 310 from the environment and from damage such as, for example, during handling of the air register 100. In a particular example, the cover 320 may protect the magnetic element 310 from damage during insertion of the air register 100 into or removal of the air register 100 from a register boot. For example, the magnetic element 310 may have a protective coating such as, for example, zinc, chrome, or nickel plating that could be damaged or worn during handling or the air register 100. Such a coating may act to protect the magnet against the environment and damage such as, for example, due to corrosion and/or oxidation. For example, an uncoated neodymium magnet or one with a compromised or damaged coating may be damaged by oxidation. Conveniently, the cover 320 may protect a coating on the magnetic element 310 so as to prevent or limit wear or damage thereto.

The cover 320 may cover all or a portion of the magnetic element 310. For example, the cover 320 may cover the magnetic element 310 of magnet 300 along at least the outside face of the wall—e.g., the outside face of one of the side walls 120. Conveniently, covering the outside face of the wall may provide one or all of the above-described benefits against wear or damage to the magnet 300 such as, for example, during insertion and/or removal of the air register 100 to/from a register boot.

The cover 320 may be formed of the same material as the side wall 120 or as other parts of the air register 100 such as, for example, the same as one or more of the end walls 130 or the grating 110.

The cover 320 may be formed of a plastic such as, for example, polystyrene.

In some embodiments, the cover 320 may be formed of an elastomeric material. For example, the cover 320 may be formed of silicone. In a particular example, a silicone film may be employed such as, for example, a silicone film having a durometer of about Shore 40A. Forming the cover 320 of an elastomeric material may provide a friction fit between the magnet 300, the cover 320, and the slot 330 so as to retain the magnet in the slot 330. Additionally or alternatively, a cover 320 formed of an elastomeric material may allow looser manufacturing tolerances for one or both of the magnet 300 and the slot 330 as such a cover may distort to provide a suitably tight fit between the magnet 300, the cover 320, and the slot 330 despite minor variances in component dimensions.

In addition or as an alternative to a friction fit between one or more of the magnet 300, the cover 320, and the slot 330, a suitable adhesive that is compatible with the relevant materials may be employed. For example, in some embodiments, a suitable epoxy resin may be employed.

A cover 320 formed of an elastomeric material may have an outside surface 340 of the cover 320 that acts as a bearing surface for frictionally retaining the air register 100 in a register boot. Such a frictional retention may co-operate with a magnetic retention by way of one or more of the magnets 140 to enhance the retention of the air register 100 in a magnetic register boot. Additionally, such a combination of frictional and magnetic retention may allow the air register to be retained in a register boot that is only partially magnetic such as, for example, a register boot that is only partially magnetic. In another example, frictional retention alone such as, for example, by way of the cover 320, may suffice to retain the air register 100 in a register boot formed of a non-magnetic material such as, for example, plastic. Plastic register boots may be manufactured to tighter manufacturing tolerances and/or may warp or distort less during use as compared to sheet metal register boots. Conveniently, a register boot having a tighter manufacturing tolerance may enhance the ability of the air register 100 to be retained therein using only frictional retention. Where the air register 100 is a ceiling register frictionally retained in a register boot, the frictional retention may resist the pull of gravity on the air register 100. Additionally or alternatively, frictional retention of the air register 100 in a register boot may resist rattling in and/or expulsion from the register boot such, for example, due to flowing air. Additionally or alternatively, frictional retention of the air register 100 in a register boot may prevent or limit the ability of a child to easily remove the air register 100 such as, for example, from a floor opening.

In some embodiments, the air register 100 may include patches or areas formed of a resilient material on the outside of one or more of the side walls 120 and/or the end walls 130—i.e., other than resilient material acting as a cover for one or more of the magnets 140—that act as bearing surfaces to further enhance frictional retention.

In some embodiments, one or more of the magnets 140 may be retained in a slot akin to the slot 330 without the use of a cover. Such a magnet may be retained in such a slot by friction fit between the magnet and the slot and/or by way of a suitable adhesive. For example, an epoxy resin may be employed.

One or more of the side walls 120, the end walls 130, and the grating 110 may be formed all or in part using lightweight materials. For example, a suitable plastic may be employed. In other words, one or more of the frame and the grating 110 may be formed of plastic. In a particular example, the plastic may be polystyrene. Plastic components may be formed using suitable molding techniques. For example, it may be that injection molding and/or blow molding is employed. Conveniently, forming one or more of the side walls 120, the end walls 130, and the grating 110 of lightweight materials may reduce the magnetic force necessary for retaining the air register 100. A reduced magnetic force necessary for retaining the air register 100 may reduce the strength of magnets 140 required. Conveniently, less strong magnets may be more inexpensive than stronger magnets. In some embodiments, one or more of the side walls 120, the end walls 130, and the grating 110 may be formed together as a monolithic component.

Conveniently, an air register according to the present application may be retained in a magnetic register boot without the use of fasteners such as, for example, screws. Accordingly, the air register 100 may, as illustrated, not contain any screw holes. Additionally or alternatively, an air register according to the present application may be frictionally retained in a wholly or partially non-magnetic register boot and may, therefore, also omit screw holes.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

As noted, certain adaptations and modifications of the described embodiments can be made. Therefore, the above-discussed embodiments are considered to be illustrative and not restrictive.

What is claimed is:

1. An air register comprising:

a grating;

a frame having side and end walls and sized to fit in a register boot, the walls extending substantially orthogonally from a rear face of the grating, the frame defining a plurality of slots; and a plurality of magnets for magnetically retaining the air register in register boots at least partially formed of one or more magnetic materials, wherein each of the magnets is directly fixed within a respective one of the slots and fixedly positioned relative to the walls.

2. The air register of claim 1, wherein each of the walls has a single corresponding one of the magnets.

3. The air register of claim 2, wherein each of the magnets is centrally-positioned on a respective one of the walls.

4. The air register of claim 1, wherein each of the walls has an outer edge furthest from the rear face of the grating, and wherein at least one of the magnets extends to an outer edge of a corresponding one of the walls.

5. The air register of claim 4, wherein the at least one of the magnets spans from the rear face of the grating to the outer edge of the corresponding one of the walls.

6. The air register of claim 1, further comprising one or more covers formed of an elastomeric material, each of the one or more covers covering a corresponding one of the magnets along at least the outside face of at least one of the walls.

7. The air register of claim 1, wherein at least a portion of the outside face of each of the walls includes a bearing surface formed of an elastomeric material for frictionally retaining the air register in register boots.

8. The air register of claim 1, wherein the magnets are rare-earth magnets.

9. The air register of claim 8, wherein at least one of the rare-earth magnets is a neodymium magnet.

10. The air register of claim 1, wherein at least one of the magnets is retained in a respective one of the slots in a respective one of the walls.

11. The air register of claim 10, wherein the at least one of the magnets is retained in its respective slot using an adhesive.

12. The air register of claim 10, wherein the at least one of the magnets is retained in its respective slot by a friction fit between that magnet, the respective slot, and a cover disposed between the magnet and the respective slot.

13. The air register of claim 12, wherein the cover is formed of an elastomeric material.

14. The air register of claim 12, wherein the cover extends to cover the magnet along the outside face of the respective one of the walls.

15. The air register of claim 1, wherein the air register does not contain any screw holes.

16. The air register of claim 1, wherein the magnets are rectangular.

17. The air register of claim 1, wherein the frame and the grating are formed of plastic.

18. The air register of claim 17, wherein the plastic is polystyrene.

* * * * *